United States Patent [19]

Mikami

[11] Patent Number: 4,933,249

[45] Date of Patent: Jun. 12, 1990

[54] ELECTROSTATOGRAPHIC PRESSURE FIXING PROCESS USING ENCAPSULATED TONER PARTICLES

[75] Inventor: Takeshi Mikami, Shizuoka, Japan

[73] Assignee: Fuji Photo Film Co., Ltd., Kanagawa, Japan

[21] Appl. No.: 233,947

[22] Filed: Aug. 18, 1988

Related U.S. Application Data

[63] Continuation of Ser. No. 58,601, Jun. 2, 1987, abandoned, which is a continuation of Ser. No. 698,239, Feb. 5, 1985, abandoned, which is a continuation of Ser. No. 469,969, Feb. 25, 1983, abandoned.

[30] Foreign Application Priority Data

Feb. 24, 1982 [JP] Japan ..... 57-27463

[51] Int. Cl.[5] ..... G03G 13/20

[52] U.S. Cl. ..... 430/98; 430/110; 430/138

[58] Field of Search ..... 430/138, 111, 109, 98

[56] References Cited

U.S. PATENT DOCUMENTS

| | | | |
|---|---|---|---|
| 3,016,308 | 1/1962 | Macaulay | 430/138 X |
| 3,338,991 | 8/1967 | Insalaco et al. | 430/137 |
| 3,510,338 | 5/1970 | Varrou | 430/120 |
| 4,016,099 | 4/1977 | Wellman et al. | 430/138 X |
| 4,216,283 | 8/1980 | Cooper et al. | 430/126 |
| 4,259,426 | 3/1981 | Hasegawa et al. | 430/138 |

*Primary Examiner*—J. David Welsh

*Attorney, Agent, or Firm*—McAulay Fisher Nissen & Goldberg

[57] ABSTRACT

An electrostatographic toner material suitably employable for a pressure fixing process, comprising a core material containing colorant and binder, and shell enclosing the core material, in which the binder comprises a polymer and a solvent having the boiling point of higher than 180° C. and capable of dissolving or swelling said polymer.

4 Claims, No Drawings

ELECTROSTATOGRAPHIC PRESSURE FIXING PROCESS USING ENCAPSULATED TONER PARTICLES

This is a continuation of application Ser. No. 058,601, filed June 2, 1987, now abandoned, which, in turn, is a continuation of application Ser. No. 698,239, filed Feb. 5, 1985, now abandoned, which, in turn is a continuation of application Ser. No. 469,969, filed Feb. 25, 1983, now abandoned.

This invention relates to an electrostatographic toner material, and more particularly relates to a pressure fixable electrostatographic toner material comprising encapsulated toner particles.

There is known the electrostatography which comprises developing a tone electrostatic latent image contained on a photoconductive or dielectric surface with a toner material containing colorant and a fixing aid to produce a visible toner image, and transferring and fixing the visible toner image onto a surface of a support medium such as a sheet of paper.

The development of the latent image to produce a visible toner image is carried out by the use of either a developing agent consisting of a combination of toner material with carrier particles, or a developing agent consisting of toner material only. The developing process utilizing the combination of toner material with carrier particles is named "two component developing process", while the developing process utilizing only the toner material is named "one component developing process".

The toner image formed on the latent image is then transferred onto a surface of a support medium and fixed thereto. The process for fixing the toner image to the support medium can be done through one of three fixing processes, that is, a heat fixing process (fusion process), a solvent fixing process and a pressure fixing process.

The pressure fixing process which involves fixing the toner material onto the surface of a support medium under application of pressure thereto is described, for instance, in U.S. Pat. No. 3,269,626. The pressure fixing process involving the use of neither the heating procedure nor the solvent produces no such troubles as inherently attached to either the heat fixing process or the solvent fixing process. Moreover, the pressure fixing process can be employed with a high speed automatic copying and duplicating process, and the access time is very short in the pressure fixing process. Accordingly, the pressure fixing process is said to be an advantageous fixing process inherently having a variety of preferable features.

However, the pressure fixing process also has a variety of inadvantageous features. For instance, the pressure fixing process generally provides poorer fixablity than the heat fixing process does, whereby the toner image fixed onto a paper is apt to rub off easily. Further, the pressure fixing process requires very high pressure for the fixing, and such a high pressure tends to break the cellulose fibers of the support medium such as paper and also produces glossy surface on the support medium. Moreover, the pressing roller requires to have relatively greater size, because the roller necessarily imparts very high pressure to the toner image on the support medium. Accordingly, reduction of the size of a copying and duplicating machine cannot exceed a certain limit defined by the size of the pressing roller.

There has been previously proposed an encapsulated toner material which comprises toner particles enclosed with micro-capsules, so as to overcome the above-described disadvantageous features of the pressure fixing process. The encapsulated toner material is prepared by enclosing core particles (containing colorant such as carbon black) with shells which are rupturable by the application of pressure. The so-prepared encapsulated toner material has various advantageous features; for instance, the fixing of the encapsulated toner material does not require very high pressure, and the fixability is excellent. Accordingly, the encapsulated toner material is viewed as suitable for the use in the pressure fixing process. However, the encapsulated toner materials proposed up to now appear unsatisfactory in practical use, because they are not able to satisfy certain characteristics required for providing smooth copying and duplicating operation and for accomplishing excellent toner image fixability and quality.

More in detail, it is required for the toner material for the use as a dry type developing agent in the electrostatography to have excellent powder characteristics (or, powder flow properties) to provide high development quality, and to be free from staining the surface of the photosensitive material on which the latent image is formed. The term "powder characteristics" particularly means resistance to agglomeration and blocking of the toner particles. In the process for the preparation of an encapsulated toner material, the toner material is generally separated from a toner dispersed solution and dried through a spray-drying procedure. The previously known encapsulated toner material is apt to undergo agglomeration either in the spray-drying process, or in the storage period after the spray-drying. The so agglomerated toner material markedly degrades the resolution of the visible toner image produced on the electrostatographic latent image, whereby markedly decreasing the sharpness of the visible toner image fixed onto the support medium.

Further, a toner material employed for the two component developing process is also required not to stain the surfaces of the carrier particles. The toner material for the use as a developing agent in the pressure fixing process is furthermore required to be satisfactory in the fixability under pressure and not to undergo off-setting against the roller surface, that is, phenomenon in which the toner adheres to the roller surface so as to stain it.

It is an object of the invention to provide an electrostatographic encapsulated toner material having improved pressure fixability.

It is another object of the invention to provide an encapsulated toner material improved in the pressure fixability, free from deterioration of the powder characteristics.

It is a further object of the invention to provide an encapsulated toner material improved in the pressure fixability which is resistant to rupture prior to the pressing operation in the pressure fixing process, while is easily rupturable in the pressure fixing operation.

The above-described objects and other objects which will be apparent from the hereinafter-given description are accomplished by the present invention, that is, an electrostatographic toner material comprising a core material containing colorant and a binder and a shell enclosing the core material, in which the binder comprises a polymer and a solvent having the boiling point of higher than 180° C. and capable of dissolving or swelling said polymer.

The shell material prepared in the invention is made of a polymer. Examples of the polymer employable as the shell material include a variety of resins such as polyurethane, polyamide, polyester, polysulfonamide, polyurea, epoxy resin, polysulfonate and polycarbonate. Preferred are polyurethane and polyurea.

In the present invention, the term "polyurethane and/or polyurea" means polymers produced by the polycondensation reaction between polyisocyanate and one or more of the counterpart compounds such as polyol, polythiol, water, polyamine and piperazine. Accordingly, the term "polyurethane" means either a simple polyurethane comprising substantially the urethane bondings only or a polymer comprising the urethane bondings and a relatively small number of the urea bonding The term "polyurea" means either a simple polyurea comprising substantially the urea bondings only or a polymer comprising the urea bondings and a relatively small number of the urethane bonding.

The shell can be composed substantially of a complex layer. For instance, the shell can comprise two or more polymers selected from the group consisting of polyurethane, polyurea and polyamide.

The encapsulation of the core material in the form of droplets with the shell material can be done by a known method for preparing the so-called micro-capsule containing a hydrophobic liquid, such as an interfacial polymerization method as described in U.S. Pat. Nos. 3,577,515, and 3,429,827, and British Pat. Nos. 950,443, 1,091,077 and 1,091,078; an inner polymerization method as described in U.S. Pat. Nos. 3,660,304, 3,726,804, 3,796,669 and 2,969,330; a phase separation method in an aqueous medium as described in U.S. Pat. Nos. 2,800,457, 2,800,458, 3,041,289, and 3,205,175; an outer polymerization method as described in U.S. Pat. Nos. 4,087,376, 4,089,802, 3,100,103, and 4,001,140; and a fusion-dispersion-cooling method as described in U.S. Pat. No. 3,167,602. Other known encapsulating methods and modifications and combinations of these encapsulating methods can be also employed.

Among these encapsulating method, the interfacial polymerization method comprising the following process is preferably employed for the preparation of the toner material of the invention.

In the first place, the following two substances are selected:

Substance (A) which as such is a hydrophobic liquid or a substance soluble, miscible or well dispersable in a hydrophobic liquid; and Substance (B) which as such is a hydrophilic liquid or a substance soluble, miscible or well dispersable in a hydrophilic liquid, in which Substance (A) can react with Substance (B) to produce a polymerization reaction product insoluble in either the hydrophobic liquid or the hydrophilic liquid.

In the second place, very small droplets of a hydrophobic liquid including Substance (A) and the core materials such as a colorant and a pressure fixable adhesive material (binder), and having an average diameter in the range from about 0.5 to about 1,000 microns are dispersed into a hydrophilic liquid such as water containing Substance (B).

A catalyst can be incorporated in either or both of the hydrophobic liquid and the hydrophilic liquid.

The Substance (A) is caused to react with Substance (B) to undergo interfacial polymerization in the dispersion by an appropriate procedure, for instance, by heating the dispersion. Thus, the shells of polymerization reaction product of Substance (A) with Substance (B) and/or water are formed around the hydrophobic droplets including the core material and the colorant, and accordingly the encapsulation of the core material and the colorant with the shell is accomplished to produce encapsulated toner particles in the aqueous liquid.

In the present invention, Substance (A) can be an acid chloride, a bischloroformate, a sulfonyl chloride, a polyisocyanate and a polyisothiocyanate, and Substance (B) can be an active-hydrogen-containing compound.

The acid chloride is selected from compounds containing two or more acid chloride groups in the molecule. Examples of the acid chlorides include adipoyl chloride, sebacoyl chloride, phthaloyl chloride, isophthaloyl chloride, terephthaloyl chloride, fumaroyl chloride, 1,4-cyclohexanedicarbonyl chloride, 4,4'-biphenyldicarbonyl chloride, 4,4'-sulfonyldibenzoyl chloride, phosgene, polyesters containing acid chloride groups, and polyamides containing acid chloride groups.

Examples of the bischloroformates include ethylene-bis(chloroformate), tetramethylene-bis(chloroformate), hexamethylene-bis(chloroformate), 2,2'-dimethyl-1,3-propane-bis(chloroformate), and p-phenylene-bis(-chloroformate).

The sulfonyl chloride is selected from compounds containing two or more sulfonyl chloride groups in the molecule. Examples of the sulfonyl chlorides include 1,3-benzenedisulfonyl chloride, 1,4-benzenedisulfonyl chloride, 1,5-naphthalenedisulfonyl chloride, 2,7-naphthalenedisulfonyl chloride, 4,4'-biphenyldisulfonyl chloride, p,p'-oxybis(benzenesulfonyl chloride), and 1,6-hexanedisulfonyl chloride.

The polyisocyanate is selected from compounds containing two or more isocyanate groups in the molecule. Examples of the polyisocyanates include m-phenylenediisocyanate, p-phenylenediisocyanate, p-phenylenediisocyanate, 2,6-tolylenediisocyanate, 2,4-tolylenediisocyanate, naphthalene-1,4-diisocyanate, diphenylmethane-4,4'-diisocyanate, diphenylmethane-4,4'-diisocyanate, 3,3'-dimethoxy-4,4'-biphenyldiisocyanate, 3,3'-dimethyldiphenylmethane-4,4'-diisocyanate, xylylene-1,4-diisocyanate, xylylene-1,3-diisocyanate, 4,4'-diphenylpropanediisocyanate, trimethylenediisocyanate, hexamethylenediisocyanate, propylene-1,2-diisocyanate, butylene-1,2-diisocyanate, ethylidynediisocyanate, cyclohexylene-1,2-diisocyanate, cyclohexylene-1,4-diisocyanate, 4,4',4''-triphenylmethanetriisocyanate, toluene-2,4,6-triisocyanate, 4,4'-dimethyldiphenylmethane-2,2',5,5'-tetraisocyanate, hexamethylenediisocyanate-hexanetriol adduct, 2,4-tolylenediisocyanate-catechol adduct, tolylenediisocyanate-trimethylolpropane adduct, and xylylenediisocyanate-trimethylolpropane adduct.

The polyisothiocyanate is selected from compounds containing two or more isothiocyanate groups in the molecule. Examples of the polyisothiocyanates include tetramethylenediisothiocyanate, hexamethylenediisothiocyanate, and p-phenylenediisothiocyanate.

Substance (A) can be employed singly or in combination.

The active-hydrogen-containing compound of Substance (B) is selected from compounds containing two or more active hydrogens in the molecule. Examples of the active-hydrogen-containing compounds include water; polyols such as ethylene glycol, 1,4-butanediol, catechol, resorcinol, hydroquinone, 1,2-dihydroxy-4-methylbenzene, 1,3-dihydroxy-5-methylbenzene, 3,4-dihydroxy-1-methylbenzene, 3,5-dihydroxy-1-methylbenzene, 2,4-dihydroxy-1-ethylbenzene, 1,3-naphthalenediol, 1,5-naphthalenediol, 2,3-naphthalenediol, 2,7-naphthalenediol, o,o'-biphenol, p,p'-biphenol, 1,1'-bi-2-naphthol, Bisphenol A, 2,2'-bis(4-hydroxyphenyl)-butane, 2,2'-bis-(4-hydroxyphenyl)isopentane, 1,1'-bis(4-hydroxyphenyl)cyclopentane, 1,1'-bis(4-hydroxyphenyl)cyclohexane, 2,2'-bis(4-hydroxy-3-methylphenyl)propane, bis(2-hydroxyphenyl)methane, xylylenediol, ethylene glycol, 1,3-propylene glycol, 1,4-butylene glycol, 1,5-pentanediol, 1,6-heptanediol, 1,7-heptanediol, 1,8-octanediol, trimethylolpropane, hexanetriol, pentaerythritol, glycerol, and sorbitol; polyamines such as ethylenediamine, tetramethylenediamine, pentamethylenediamine, hexamethylenediamine, p-phenylenediamine, m-phenylenediamine, 2-hydroxytrimethylenediamine, diethylenetriamine, triethylenetetraamine, diethylaminopropylamine, tetraethylenepentaamine, and an addition product of an epoxy compound and an amine compound; and piperazines such as piperazine, 2-methylpiperazine and 2,5-dimethylpiperazine.

In the preparation of the dispersion of the very small hydrophobic droplets containing Substance (A) and the core material, the hydrophobic liquid to be dispersed preferably contains a low-boiling solvent or a polar solvent. These solvents serve for accelerating formation of the shell which is a reaction product between the Substance (A) and the Substance (B). Examples of these solvents include methyl alcohol, ethyl alcohol, diethyl ether, tetrahydrofuran, dioxane, methyl acetate, ethyl acetate, acetone, methyl ethyl ketone, methyl isobutyl ketone, cyclohexanone, n-pentane, n-hexane, benzene, petroleum ether, chloroform, carbon tetrachloride, methylene chloride, ethylene chloride, carbon disulfide and dimethylformamide.

As for the other aspects of the interfacial polymerization method and the other processes for the preparation of micro-capsules containing an oily liquid, there are given descriptions in U.S. Pat. No. 3,726,804, which is introduced hereinto as the reference.

In the above-described process, a polyurethane can be produced if a polyisocyanate and a polyamine are employed as the Substances (A) and (B), respectively. A polyurea can be produced if a polyisocyanate and a polyol are employed as the Substances (A) and (B), respectively.

The encapsulated toner material whose shell is composed substantially of a complex layer comprising two or more polymers selected from the group consisting of polyurethane, polyurea and polyamide can be produced as follows.

In a hydrophobic liquid comprising core materials such as a colorant, and a pressure fixable adhesive material (binder), are dissolved an acid chloride and a polyisocyanate. This solution is then dispersed in an aqueous medium comprising a polyamine or piperazine and a dispersing agent to produce fine droplets of the core material having an average diameter in the range from about 0.5 to about 1,000 microns in the aqueous medium.

The dispersion produced above is then neutralized or made weak-alkaline by addition of an alkaline substance, and subsequently heated to a temperature between 40° and 90° C. Upon completion of these procedure, a complex layer consisting substantially of a polyamide and a polyurea in which the polyamide is a reaction product produced by reaction between the acid chloride and the polyamine, and the polyurea is a reaction product produced by reaction between the polyisocyanate and the polyamine, is formed around the droplet of core material. Thus, the encapsulated particle having the complex layer shell is obtained.

If a polyol is further added to the hydrophobic liquid in the above, there is produced around the hydrophobic core material droplet a complex layer shell consisting substantially of the polyamide and a polyurethane, in which the polyurethane is a reaction product of the polyisocyanate with the polyol.

In the latter procedure, a complex layer consisting substantially of the polyamide, polyurea and polyurethane can be produced, if the polyamine is introduced into the reaction system in an amount exceeding the amount required to react the introduced acid chloride.

The shell of the so produced particle is, as described above, a complex layer shell. The term "complex layer shell" means a shell comprising a polymer mixture, as well as a double layer shell. The term "double layer shell" is not intended to mean only a shell in which the two layers are completely separated by a simple interface, but include a shell in which the interface is not clearly present in the shell, but the ratio between one polymer and another polymer (or other polymers) varies from the inner phase to the outer phase of the shell.

Examples of acid chlorides are those as described hereinbefore.

The acid chloride can be replaced with a dicarboxylic acid or its acid anhydride. Examples of the dicarboxylic acids include adipic acid, sebacic acid, phthalic acid, terephthalic acid, fumaric acid, 1,4-cyclohexanedicarboxylic acid and 4,4'-biphenyldicarboxylic acid. Examples of the acid anhydrides include phthalic anhydride.

The inner polymerization method can be done in the following manner.

In a hydrophobic liquid to form the core material of the encapsulated toner particle are dissolved substance (A) and one or more substances polymerizable with the Substance (A) so as to produce a shell material, in the presence of a low boiling solvent or a polar solvent. The so obtained hydrophobic liquid is dispersed and emulsified in the aforementioned hydrophilic liquid which is not miscible with the hydrophobic liquid. The emulsion is then heated to cause removal of the low boiling solvent or polar solvent to the outside of the hydrophobic liquid droplet and simultaneously to move the shell-forming substances to the surface of the droplet. The shell-forming substances are polymerized at the surface to prepare the desired shell. Thus, the desired encapsulated toner particles dispersed in the hydrophilic liquid are obtained.

As for the other aspects of the interfacial polymerization method and the other processes for the preparation of micro-capsules containing a hydrophobic liquid, there are given descriptions in U.S. Pat. No. 2,726,804, which is introduced hereinto as reference.

The core material contains colorant for producing a visible image from the latent image. The colorant generally is a dye or a pigment, but a certain agent providing no directly visible image such as a fluorescent substance can be employed as the colorant, if desired.

The colorant is generally selected from a variety of the dye, pigment and the like employed generally in the conventional electrostatographic copying and duplicating process. Generally the colorant is a black toner or a chromatic toner. Examples of the black toners include carbon black. Examples of the chromatic toners include blue colorants such as copper phthalocyanine and a sulfonamide derivative dye; yellow colorants such as a benzidine derivative colorant, that is generally called Diazo Yellow; and red colorants such as Rhodamine B Lake that is a double salt of xanthin dye with phosphorus wolframate and molybdate, Carmine 6B belonging to Azo pigment, and a quinacridone derivative.

The core material contains a binder (adhesive material) for keeping the colorant within the core and assisting the fixation of the colorant onto the surface of a support medium such as paper. The present invention is characterized in that the binder comprises a polymer and a solvent having the boiling point of higher than 130° C. and capable of dissolving or swelling said polymer.

There is known a binder to be contained in the core material, which comprises a mixture of a polymer and a easily volatile low boiling solvent, as described in Japanese Patent Provisional Publication No. 56(1981)-144434, etc. This art is based on the conception that an encapsulated toner material placed on a support medium such as paper is broken resulting in adhesion of a mixture of the polymer and the volatile low boiling solvent as well as the colorant under pressure, and the polymer assists fixation of the colorant and the remaining shell upon volatilization of the low boiling solvent.

As a result of the study of the above-identified prior art, the present inventor has discovered that the binder comprising the polymer and the volatile low boiling solvent is not able to provide satisfactory adhesion to a support medium to the colorant and that the volatile low boiling solvent deteriorates the working conditions in the preparation of the encapsulated toner material as well as in the copying procedure, because the low boiling solvent is apt to emit offensive odor and is inflammable. Moreover, an encapsulated toner material comprising the low boiling solvent in the core becomes poor in adhesion during storage, presumably because of the volatilization of the low boiling solvent through the shell.

In contrast, the binder composition of the invention comprising a polymer and the high boiling solvent assists more effectively the adhesion of colorant onto a support medium such as paper, as compared with the binder composition comprising the polymer and low boiling solvent. Further, the visible toner image fixed onto the support medium is kept under satisfactory conditions in the storage. Furthermore, there is brought about no such problems as fire and offensive odor.

Examples of the polymers include the following polymers:

polyolefins, olefin copolymers, polystyrene, styrenebutadiene copolymer, epoxy resins, polyesters, natural and synthetic rubbers, polyvinylpirrolidone, polyamides, cumarone-indene copolymer, methyl vinyl ether-maleic anhydride copolymer, maleic acid-modified phenol resin, phenol-modified terpene resin, silicone resins, epoxy-modified phenol resin, amino resins, polyurethane elastomers, polyurea elastomers, homopolymers and copolymers of acrylic acid ester, homopolymers and copolymers of methacrylic acid ester, acrylic acid-long chain alkyl methacrylate copolymer oligomer, poly(vinyl acetate), and poly(vinyl chloride).

The above-listed polymers and examples of other polymers employable in the invention are described in detail in the following publications:

Japanese Patent Publications Nos. 48(1973)-30,499, 49(1974)-1,588 and 54(1979)-8,104; Japanese Patent Provisional Publications Nos. 48(1973)-75,032, 48(1973)-78,931, 49(1974)-17,739, 51(1976)-132,838, 52(1977)-98,531, 52(1977)-108,134, 52(1977)-119,937, 53(1978)-1,028, 53(1978)-36,243, 53(1978)-118,049, 55(1980)-89,854 and 55(1980)-166,655; and U.S. Pat. Nos. 3,788,994 and 3,893,933.

In the invention, the polymer is preferably selected from the group consisting of homopolymer and copolymers of acrylic acid ester (acrylate), homopolymer and copolymers of methacrylic acid ester (methacrylate), and styrene-butadiene copolymers.

Examples of the solvent having the boiling point of higher than 180° C. and capable of dissolving or swelling the polymer include the following liquid:

(1) Phthalic acid esters dibutyl phthalate, dihexyl phthalate, diheptyl phthalate, dioctyl phthalate, dinonyl phthalate, dodecyl phthalate, butyl phthalyl butyl glycolate, dibutyl monofluorophthalate;

(2) Phosphoric acid esters tricresyl phosphate, trixylenyl phosphate, tris(isopropylphenyl) phosphate, tributyl phosphate, trihexyl phosphate, trioctyl phosphate, trinonyl phosphate, tridecyl phosphate, trioleyl phosphate, tris(butoxyethyl) phosphate, tris(chloroethyl) phosphate, tris(dichloropropyl) phosphate;

(3) Citric acid esters

O-acetyl triethyl citrate, O-acetyl tributyl citrate, O-acetyl trihexyl citrate, O-acetyl trioctyl citrate, O-acetyl trinonyl citrate, O-acetyl tridecyl citrate, triethyl citrate, tributyl citrate, trihexyl citrate, trioctyl citrate, trinonyl citrate, tridecyl citrate;

(4) Benzoic acid esters butyl benzoate, hexyl benzoate, heptyl benzoate, octyl benzoate, nonyl benzoate, decyl benzoate, dodecyl benzoate, tridecyl benzoate, tetradecyl benzoate, hexadecyl benzoate, octadecyl benzoate, oleyl benzoate, pentyl o-methylbenzoate, decyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methoxybenzoate;

(5) Aliphatic acid esters hexadecyl myristate, dibutoxyethyl succinate, dioctyl adipate, dioctyl azelate, decamethylene-1,10-diol diacetate, triacetin, tributin, benzyl caprate, pentaerythritol tetracaproate, isosorbitol dicaprilate;

(6) Alkylnaphthalenes methylnaphthalene, dimethylnaphthalene, trimethylnaphthalene, tetramethylnaphthalene, ethylnaphthalene, diethylnaphthalene, triethylnaphthalene, monoisopropylnaphthalene, diisopropylnaphthalene, tetraisopropylnaphthalene, monomethylethylnaphthalene, isooctylnaphthalene;

(7) Dialkylphenyl ethers di-o-methylphenyl ether, di-m-methyldiphenyl ether, di-p-methylphenyl ether;

(8) Amides of fatty acids and aromatic sulfonic acids

N,N-dimethyllauroamide, N,N-diethylcaprylamide, N-butylbenzenesulfonamide;

(9) Trimellitic acid esters trioctyl trimellitate;

(10) Diarylalkanes diarylmethanes such as dimethylphenylphenylmethane, diarylethanes such as 1-methylphenyl-1-phenylethane, 1-dimethylphenyl-1-phenylethane and 1-ethylphenyl-1-phenylethane.

For the purpose of the invention, the high-boiling solvent is preferably selected from phthalic acid esters, phosphoric acid esters. diarylalkanes and alkylnaphthalenes.

In the invention, each of the polymer and the high boiling solvent can be employed alone or in combination.

There is no limitation on the ratio between the high boiling solvent and the polymer, but the ratio is preferably chosen within the range of 0.1–40 (high boiling solvent/polymer), ratio by weight. The mixture of the polymer and high boiling solvent sometimes shows very high viscosity depending upon the combination of the polymer and the solvent, and the ratio therebetween. Such a viscous mixture is hardly emulsified in satisfactory conditions in the initial stage for the preparation of the small droplets of the core material. In that case, a low boiling solvent miscilbe with the high boiling solvent and polymer but non-miscible with water, such as ethyl acetate or butyl acetate, is preferably added to the mixture to decrease the viscosity and facilitate the formation of satisfactory emulsion. The low boiling solvent is removed upon formation of the emulsion under reduced pressure.

The core material of the invention can further contain a magnetizable substance, preferably in the form of fine particles.

As for the magnetizable substances, there are given descriptions, for instance, in Japanese Patent Provisional Publications Nos. 53(1978)-118,053, 53(1978)-1,028 and 55(1980)-166,655. Examples of materials of the magnetizable substances include metals such as cobalt, iron and nickel; metal alloys or metal compositions comprising aluminum, cobalt, copper, iron, lead, magnesium, nickel, tin, zinc, gold, silver, antimony, beryllium, bismuth, cadmium, calcium manganese, titanium, tungsten, vanadium and/or zirconium; metallic compounds including metal oxides such as aluminium oxide, ferric oxide, cupric oxide, nickel oxide, zinc oxide, zirconium oxide, titanium oxide and magnesium oxide; refractory metal nitrides such as chromium nitride; metal carbides such as tungsten carbide and silica carbide; ferromagnetic ferrite; and their mixtures.

The releasing agent can be further contained in the core material for keeping the ruptured shell and the released core material from adhering to the surface of the pressing roller. The releasing agent can be chosen from those proposed for employment in the previously reported encapsulated toners. Examples of the releasing agents include a fluorine-containing resin described in Japanese Patent Provisional Publications Nos. 55(1980)-142,360 and 55(1980)-142,362.

As mentioned hereinbefore, a process for the preparation of the encapsulated toner particles generally includes a stage for dispersing or emulsifying very small droplets of the hydrophobic liquid containing Substance (A) and the core material in the aqueous medium. For the preparation of the homogeneous dispersion (or emulsion) of the very small droplets of the hydrophobic liquid, it is preferred to incorporate into the reaction liquid a hydrophilic protective colloid and/or an emulsifying surface active agent which assist the production of the homogeneous dispersion (or emulsion) of the hydrophobic droplets and prevention of agglomeration of the so-produced hydrophobic droplets. The hydrophilic protective colloid and the surface active agent can be employed alone or in combination.

Dispersing or emulsifying the reaction liquid can be carried out by means of a known homogenizer such as one belonging to the stirring type, the high pressure injecting type, the ultrasonic vibrating type and the kneader type. Particularly preferred homogenizers are a colloid mill, a conventional homogenizer, and electromagnetic distortion inducing ultrasonic homogenizer.

The encapsulated toner is then produced, for instance, by heating the emulsified reaction liquid in the presence of an appropriate catalyst, as described hereinbefore, so as to form shells around the core material droplets. Subsequently, the encapsulated toner is separated from the aqueous reaction medium and dried to obtain a dry encapsulated toner. The encapsulated toner is preferably washed with water after the separation from the aqueous reaction medium and prior to the drying procedure. The drying procedure can be carried out by a known process such as the spray-drying process or the freeze-drying process. The spray-drying process is preferred.

The so dried encapsulated toner particles are preferably heated to improve their powder characteristics. The temperature for heating the dried encapsulated toner particles preferably ranges from 50° to 300° C., and more preferably ranges from 80° to 150° C. The period required for the heating procedure varies with the heating temperature, the nature of the binder, and so on. Generally, the period ranges from 10 minutes to 48 hours, and preferably ranges from 2 to 24 hours.

There is no limitation on means employed for carrying out the heating procedure. Examples of the heating means include an electric furnace, a muffle furnace, a hot plate, an electric drying oven, a fluid bed drying apparatus, and an infrared drying apparatus.

The dry encapsulated toner can be admixed with an insulating material and/or a charge controller such as a metal-containing dye or Nigrosin dye.

A dry encapsulated toner can be admixed with a flow lubricant such as hydrophobic silica powder so that the flow lubricant can be dispersed over the surface of the encapsulated toner. The encapsulated toner having the flow lubricant such as hydrophobic silica powder over the toner surface shows particularly improved powder quality and property, and accordingly is very advantageous in the practical use.

The encapsulated toner obtained as above can be introduced into the electrostatographic copying and duplicating machine to develop an electrostatographically produced latent image so as to produce a visible toner image on the surface of the photoconductive material. The visible image is then fixed onto a support medium such as paper by means of an appropriate pressure fixing apparatus. There is no limitation on the pressure fixing apparatus for fixing the encapsulated toner of the invention, and any known apparatus can be applied to the fixing of the encapsulated toner of the invention. Examples of the pressure fixing apparatuses include those illustrated in Japanese Patent Publications Nos. 44(1969)-9,880, 44(1969)-12,797, and 46(1971)-15,876; and Japanese Patent Provisional Publications Nos. 49(1974)-62,143, 49(1974)-77,641, 50(1975)-51,333, 51(1976)-31,235, 51(1976)-40,351, 52(1977)-15,335, 52(1977)-102,743, 54(1979)-28,636, 54(1979)-32,326, 54(1979)-41,444, and 54(1979)-48,251.

The electrostatographic toner material according to the invention has improved powder characteristics, and further is resistant to the mechanical shock and abrasion in the developing apparatus of the electrostatographic copying and duplicating machine. Particularly, the electrostatographic toner material is easily rupturable in the pressure fixing apparatus to produce a visible toner image well fixed onto the support medium such as paper. Further, the toner material hardly undergoes offsetting to a pressing roller and hardly undergoes the so-called filming on the surfaces of the carrier particles, the developing sleeves and the photoconductive material.

Other features of the electrostatographic copying and duplicating process employing an encapsulated toner material are described in U.S. Pat. No. 3,788,994, which is introduced hereinto as reference.

The present invention will be illustrated by the following examples which are by no means intended to introduce any restriction into the invention.

EXAMPLE 1

A primary liquid was prepared by preparing a dispersion of 1 g. of carbon black in 13 g. of 10% poly(isobutyl methacrylate) solution (in dibutyl phthalate) and dissolving 1 g. of an addition product of tolylene diisocyanate and hexanetriol (3:1 molar ratio) in the dispersion.

Separately, a secondary liquid was prepared by dissolving 1 g. of poly(vinyl alcohol) (polymerization degree: 500, saponification degree: 98%) in 100 g. of water.

The secondary liquid was cooled to 10° C. and added dropwise to the primary liquid under stirring by means of a high speed rotation homogenizer to prepare an oil-in-water type emulsion containing oily droplets having average diameter of 10 μm. The stirring was further continued even after the production of emulsion to complete the encapsulating reaction.

The so prepared microcapsule dispersion was subjected to centrifugal separation at 5,000 r.p.m. The supernatant was removed, and the residual microcapsules were again subjected to the centrifugal separation after addition of water. The water-washing procedure was repeated twice to remove the poly(vinyl alcohol) from the aqueous dispersion.

The dispersion was dried by means of a spray dryer under the conditions of the entrance temperature 170° C., the exit temperature 110° C., and the atomizing pressure 2 kg/cm$^2$. There was obtained a powdery encapsulated toner material comprising the poly(isobutyl methacrylate), dibutyl phthalate and carbon balck in the core.

The so prepared powdery toner material flowed very easily. Microscopic observation on the toner material indicated that the toner particles were present independently and that no bulky agglomerated particles were formed.

The evaluation of the toner material was carried out as follows:

Five parts by weight of the toner material were admixed with 95 parts by weight of powdery iron carrier in a shaking apparatus to prepare a developing agent. It was confirmed through microscopic observation for the above toner material that the developing agent contained no ruptured toner particles.

A conventional electrostatographic copying and duplicating process was carried out using the above developing agent. The visible toner image produced on a latent image was then converted onto a paper. The paper carrying the toner image was treated under a pressing roller at a pressure of 350 kg./cm$^2$. There was obtained a toner image with high sharpness and well fixed onto the paper. Further, off-setting of the toner was at a very low level.

In the copying process, no offensive odor was noted. The toner image fixed to the paper was hardly rubbed off and no adverse effect was given to the visible image.

COMPARISON EXAMPLE 1

The procedures of Example 1 were repeated except that the dibutyl phthalate was replaced with the same amount of toluene. There was obtained a powdery encapsulated toner material comprising poly(isobutyl methacrylate), toluene and carbon black in the core.

The so prepared powdery toner material was mixed with iron carrier and the electrostatographic copying and duplicating process was carried out in the same manner as in Example 1. A visible toner image converted onto a paper was pressed under a pressing roller at a pressure of 350 kg./cm$^2$. Soon after starting the pressing procedure, an offensive odor of toluene was noted. The toner image fixed to the paper was easily rubbed off, staining the finger with carbon black, and the visible image also was stained.

EXAMPLE 2

The procedures of Example 1 were repeated except that the poly(isobutyl methacrylate) and dibutyl phthalate were replaced with the same amounts of poly(ethyl methacrylate) and triisopropylnaphthalene, respectively. There was obtained a powdery encapsulated toner material comprising poly(ethyl methacrylate), triisopropylnaphthalene and carbon black in the core.

The so prepared powdery toner material was mixed with iron carrier and the electrostatographic copying and duplicating process was carried out in the same manner as in Example 1. There was obtained a toner image with high sharpness and well fixed onto the paper. Further, off-setting of the toner was at a very low level.

In the copying process, no offensive odor was noted. The toner image fixed to the paper was hardly rubbed off and no adverse effect was given to the visible image.

COMPARISON EXAMPLE 2

The procedures of Example 2 were repeated except that the triisopropylnaphthalene was replaced with the same amount of xylene. There was obtained a powdery encapsulated toner material comprising poly(ethyl methacrylate), xylene and carbon black in the core.

The so prepared powdery toner material was mixed with iron carrier and the electrostatographic copying and duplicating process was carried out in the same manner as in Example 1. A visible toner image converted onto a paper was pressed under a pressing roller at a pressure of 350 kg./cm$^2$. Soon after starting the pressing procedure, an offensive odor of xylene was noted. The toner image fixed to the paper was easily rubbed off, staining the finger with carbon black, and the visible image also was stained.

EXAMPLE 3

The procedures of Example 1 were repeated except that the poly(isobutyl methacrylate) and dibutyl phthalate were replaced with the same amounts of styrene-butadiene copolymer and triisopropylnaphthalene, respectively. There was obtained a powdery encapsulated toner material comprising styrene-butadiene copolymer, triisopropylnaphthalene and carbon black in the core.

The so prepared powdery toner material was mixed with iron carrier and the electrostatographic copying and duplicating process was carried out in the same manner as in Example 1. There was obtained a toner image with high sharpness and well fixed onto the paper. Further, off-setting of the toner was at a very low level.

In the copying process, no offensive odor was noted. The toner image fixed to the paper was hardly rubbed off and no adverse effect was given to the visible image.

COMPARISON EXAMPLE 3

The procedures of Example 3 were repeated except that the triisopropylnaphthalene was replaced with the same amount of ethyl acetate. There was obtained a powdery encapsulated toner material comprising styrene-butadiene copolymer, ethyl acetate and carbon black in the core.

The so prepared powdery toner material was mixed with iron carrier and the electrostatographic copying and duplicating process was carried out in the same manner as in Example 1. A visible toner image converted onto a paper was pressed under a pressing roller at a pressure of 350 kg./cm$^2$. Soon after starting the pressing procedure, an odor of ethyl acetate was noted. The toner image fixed to the paper was easily rubbed off, staining the finger with carbon black, and the visible image also was stained.

The odor of ethyl acetate was noted even after lapse of one month, and at that time the toner image was more easily rubbed off.

I claim:

1. In a process which comprises developing an electrostatic latent image with a toner material to produce a toner image, transferring the toner image on a support medium, and fixing the toner image onto the support medium through a pressure fixing process, the improvement which comprises using as the toner material, encapsulated toner particles which comprise a core material containing a colorant and a binder and a shell enclosing the core material, in which said binder comprises a polymer and a diarylalkylene or an alkylnaphthalene having a boiling point of higher than 180° C. and being capable of dissolving or swelling said polymer, the ratio by weight of said polymer to said solvent being 0.1 to 40, and in which said shell is of a material selected from the group consisting of a polyurethane, a polyurea, a combination of polyurethane and polyurea, a combination of polyurethane and polyamide, and a combination of polyurethane, polyurea and polyamide.

2. The process of claim 1, in which the polymer is selected from the group consisting of homopolymers and copolymers of acrylic acid esters, homopolymers and copolymers of methacrylic acid esters, and styrene-butadiene copolymers.

3. The process of claim 1, in which the solvent is selected from the group consisting of phthalic acid esters, phosphoric acid esters, citric acid esters, benzoic acid esters, aliphatic acid esters, alkylnaphthalenes, alkyldiphenyl ethers, amides of fatty acids and aromatic sulfonic acids, trimelltic acid esters, and diarylalkylenes.

4. The process of claim 1 wherein the shell is a polyurea, polyurethane, or a combination of a polyurea and a polyurethane.

* * * * *